US008470396B2

(12) United States Patent
Miller et al.

(10) Patent No.: US 8,470,396 B2
(45) **Date of Patent: *Jun. 25, 2013**

(54) DYNAMIC DEHYDRIDING OF REFRACTORY METAL POWDERS

(75) Inventors: Steven A. Miller, Canton, MA (US); Mark Gaydos, Nashua, NH (US); Leonid N. Shekhter, Ashland, MA (US); Gokce Gulsoy, Newton, MA (US)

(73) Assignee: H.C. Starck Inc., Newton, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/551,747

(22) Filed: Jul. 18, 2012

(65) Prior Publication Data

US 2012/0315387 A1 Dec. 13, 2012

Related U.S. Application Data

(63) Continuation of application No. 12/206,944, filed on Sep. 9, 2008, now Pat. No. 8,246,903.

(51) Int. Cl.

| | |
|---|---|
| ***B05D 1/12*** | (2006.01) |
| ***B05D 1/36*** | (2006.01) |
| ***B05D 1/08*** | (2006.01) |
| ***C23C 4/08*** | (2006.01) |
| ***H05H 1/24*** | (2006.01) |

(52) U.S. Cl.
USPC ..... 427/180; 427/404; 427/446; 427/455; 427/569

(58) Field of Classification Search
None
See application file for complete search history.

(56) References Cited

U.S. PATENT DOCUMENTS

| | | | |
|---|---|---|---|
| 3,436,299 | A | 4/1969 | Halek |
| 3,990,784 | A | 11/1976 | Gelber |
| 4,011,981 | A | 3/1977 | Danna et al. |
| 4,073,427 | A | 2/1978 | Keifert et al. |
| 4,135,286 | A | 1/1979 | Wright et al. |
| 4,140,172 | A | 2/1979 | Corey |
| 4,202,932 | A | 5/1980 | Chen et al. |
| 4,209,375 | A | 6/1980 | Gates et al. |
| 4,291,104 | A | 9/1981 | Keifert |
| 4,349,954 | A | 9/1982 | Banks |
| 4,425,483 | A | 1/1984 | Lee et al. |
| 4,459,062 | A | 7/1984 | Siebert |

(Continued)

FOREIGN PATENT DOCUMENTS

| | | | |
|---|---|---|---|
| CA | 2482287 | A1 | 10/2002 |
| DE | 10253794 | A1 | 6/2004 |

(Continued)

OTHER PUBLICATIONS

"Cold Gas Dynamic Spray CGSM Apparatus," Tev Tech LLC, available at: http://www.tevtechllc.com/cold_gas.html (accessed Dec. 14, 2009).

(Continued)

*Primary Examiner* — Patrick Ryan
*Assistant Examiner* — Yoshitoshi Takeuchi
(74) *Attorney, Agent, or Firm* — Bingham McCutchen LLP

(57) ABSTRACT

Refractory metal powders are dehydrided in a device which includes a preheat chamber for retaining the metal powder fully heated in a hot zone to allow diffusion of hydrogen out of the powder. The powder is cooled in a cooling chamber for a residence time sufficiently short to prevent re-absorbtion of the hydrogen by the powder. The powder is consolidated by impact on a substrate at the exit of the cooling chamber to build a deposit in solid dense form on the substrate.

14 Claims, 2 Drawing Sheets

U.S. PATENT DOCUMENTS

| | | | |
|---|---|---|---|
| 4,483,819 | A | 11/1984 | Albrecht et al. |
| 4,508,563 | A | 4/1985 | Bernard et al. |
| 4,510,171 | A | 4/1985 | Siebert |
| 4,537,641 | A | 8/1985 | Albrecht et al. |
| 4,722,756 | A | 2/1988 | Hard |
| 4,731,111 | A | 3/1988 | Kopatz et al. |
| 4,818,629 | A | 4/1989 | Jenstrom et al. |
| 4,915,745 | A | 4/1990 | Pollock et al. |
| 4,964,906 | A | 10/1990 | Fife |
| 5,061,527 | A | 10/1991 | Watanabe et al. |
| 5,091,244 | A | 2/1992 | Biornard |
| 5,147,125 | A | 9/1992 | Austin |
| 5,242,481 | A | 9/1993 | Kumar |
| 5,269,899 | A | 12/1993 | Fan |
| 5,270,858 | A | 12/1993 | Dickey |
| 5,271,965 | A | 12/1993 | Browning |
| 5,302,414 | A | 4/1994 | Alkhimov et al. |
| 5,305,946 | A | 4/1994 | Heilmann |
| 5,330,798 | A | 7/1994 | Browning |
| 5,392,981 | A | 2/1995 | Makowiecki et al. |
| 5,428,882 | A | 7/1995 | Makowiecki et al. |
| 5,466,355 | A | 11/1995 | Ohhashi et al. |
| 5,565,071 | A | 10/1996 | Demaray et al. |
| 5,580,516 | A | 12/1996 | Kumar |
| 5,612,254 | A | 3/1997 | Mu et al. |
| 5,676,803 | A | 10/1997 | Demaray et al. |
| 5,679,473 | A | 10/1997 | Murayama et al. |
| 5,687,600 | A | 11/1997 | Emigh et al. |
| 5,693,203 | A | 12/1997 | Ohhashi et al. |
| 5,738,770 | A | 4/1998 | Strauss et al. |
| 5,795,626 | A | 8/1998 | Gabel et al. |
| 5,836,506 | A | 11/1998 | Hunt et al. |
| 5,859,654 | A | 1/1999 | Radke et al. |
| 5,863,398 | A | 1/1999 | Kardokus et al. |
| 5,954,856 | A | 9/1999 | Pathare et al. |
| 5,955,685 | A | 9/1999 | Na |
| 5,972,065 | A | 10/1999 | Dunn et al. |
| 5,993,513 | A | 11/1999 | Fife |
| 6,010,583 | A | 1/2000 | Annavarapu et al. |
| 6,030,577 | A | 2/2000 | Commandeur et al. |
| 6,071,389 | A | 6/2000 | Zhang |
| 6,136,062 | A | 10/2000 | Loffelholz et al. |
| 6,139,913 | A | 10/2000 | Van Steenkiste et al. |
| 6,165,413 | A | 12/2000 | Lo et al. |
| 6,171,363 | B1 | 1/2001 | Shekhter et al. |
| 6,176,947 | B1 | 1/2001 | Hwang et al. |
| 6,189,663 | B1 | 2/2001 | Smith et al. |
| 6,197,082 | B1 | 3/2001 | Dorvel et al. |
| 6,238,456 | B1 | 5/2001 | Wolf et al. |
| 6,245,390 | B1 | 6/2001 | Baranovski et al. |
| 6,258,402 | B1 | 7/2001 | Hussary et al. |
| 6,261,337 | B1 | 7/2001 | Kumar |
| 6,267,851 | B1 | 7/2001 | Hosokawa |
| 6,283,357 | B1 | 9/2001 | Kulkarni et al. |
| 6,294,246 | B1 | 9/2001 | Watanabe et al. |
| 6,328,927 | B1 | 12/2001 | Lo et al. |
| 6,331,233 | B1 | 12/2001 | Turner |
| 6,408,928 | B1 | 6/2002 | Heinrich et al. |
| 6,409,897 | B1 | 6/2002 | Wingo |
| 6,409,965 | B1 | 6/2002 | Nagata et al. |
| 6,432,804 | B1 | 8/2002 | Nakata et al. |
| 6,444,259 | B1 | 9/2002 | Subramanian et al. |
| 6,464,933 | B1 | 10/2002 | Popoola et al. |
| 6,478,902 | B2 | 11/2002 | Koenigsmann et al. |
| 6,482,743 | B1 | 11/2002 | Sato |
| 6,491,208 | B2 | 12/2002 | James et al. |
| 6,497,797 | B1 | 12/2002 | Kim |
| 6,502,767 | B2 | 1/2003 | Kay et al. |
| 6,521,173 | B2 | 2/2003 | Kumar et al. |
| 6,558,447 | B1 | 5/2003 | Shekhter et al. |
| 6,582,572 | B2 | 6/2003 | McLeod |
| 6,589,311 | B1 | 7/2003 | Han et al. |
| 6,623,796 | B1 | 9/2003 | Van Steenkiste |
| 6,669,782 | B1 | 12/2003 | Thakur |
| 6,722,584 | B2 | 4/2004 | Kay et al. |
| 6,723,379 | B2 | 4/2004 | Stark |
| 6,725,522 | B1 | 4/2004 | Conard et al. |
| 6,743,343 | B2 | 6/2004 | Kida et al. |
| 6,743,468 | B2 | 6/2004 | Fuller et al. |
| 6,749,002 | B2 | 6/2004 | Grinberg et al. |
| 6,749,103 | B1 | 6/2004 | Ivanov et al. |
| 6,759,085 | B2 | 7/2004 | Muehlberger |
| 6,770,154 | B2 | 8/2004 | Koenigsmann et al. |
| 6,773,969 | B2 | 8/2004 | Lee et al. |
| 6,780,458 | B2 | 8/2004 | Seth et al. |
| 6,855,236 | B2 | 2/2005 | Sato et al. |
| 6,872,425 | B2 | 3/2005 | Kaufold et al. |
| 6,872,427 | B2 | 3/2005 | Van Steenkiste et al. |
| 6,875,324 | B2 | 4/2005 | Hara et al. |
| 6,896,933 | B2 | 5/2005 | Van Steenkiste et al. |
| 6,905,728 | B1 | 6/2005 | Hu et al. |
| 6,911,124 | B2 | 6/2005 | Tang et al. |
| 6,915,964 | B2 | 7/2005 | Tapphorn et al. |
| 6,919,275 | B2 | 7/2005 | Chiang et al. |
| 6,924,974 | B2 | 8/2005 | Stark |
| 6,946,039 | B1 | 9/2005 | Segal et al. |
| 6,953,742 | B2 | 10/2005 | Chen et al. |
| 6,962,407 | B2 | 11/2005 | Yamamoto et al. |
| 6,992,261 | B2 | 1/2006 | Kachalov et al. |
| 7,041,204 | B1 | 5/2006 | Cooper |
| 7,053,294 | B2 | 5/2006 | Tuttle et al. |
| 7,067,197 | B2 | 6/2006 | Michaluk et al. |
| 7,081,148 | B2 | 7/2006 | Koenigsmann et al. |
| 7,101,447 | B2 | 9/2006 | Turner |
| 7,108,893 | B2 | 9/2006 | Van Steenkiste et al. |
| 7,128,988 | B2 | 10/2006 | Lambeth |
| 7,143,967 | B2 | 12/2006 | Heinrich et al. |
| 7,146,703 | B2 | 12/2006 | Ivanov |
| 7,153,453 | B2 | 12/2006 | Abe et al. |
| 7,163,715 | B1 | 1/2007 | Kramer |
| 7,164,205 | B2 | 1/2007 | Yamaji et al. |
| 7,170,915 | B2 | 1/2007 | McDonald |
| 7,175,802 | B2 | 2/2007 | Sandlin et al. |
| 7,178,744 | B2 | 2/2007 | Tapphorn et al. |
| 7,183,206 | B2 | 2/2007 | Shepard |
| 7,192,623 | B2 | 3/2007 | Andre et al. |
| 7,208,230 | B2 | 4/2007 | Ackerman et al. |
| 7,244,466 | B2 | 7/2007 | Van Steenkiste |
| 7,278,353 | B2 | 10/2007 | Langan et al. |
| 7,314,650 | B1 | 1/2008 | Nanis |
| 7,316,763 | B2 | 1/2008 | Hosokawa et al. |
| 7,335,341 | B2 | 2/2008 | Van Steenkiste et al. |
| 7,399,335 | B2 | 7/2008 | Shekhter et al. |
| 7,402,277 | B2 | 7/2008 | Ayer et al. |
| 7,479,299 | B2 | 1/2009 | Raybould et al. |
| 7,514,122 | B2 | 4/2009 | Kramer |
| 7,550,055 | B2 | 6/2009 | Le et al. |
| 7,582,846 | B2 | 9/2009 | Molz et al. |
| 7,618,500 | B2 | 11/2009 | Farmer et al. |
| 7,635,498 | B2 | 12/2009 | Sakai et al. |
| 7,644,745 | B2 | 1/2010 | Le et al. |
| 7,652,223 | B2 | 1/2010 | Tanase et al. |
| 7,670,406 | B2 | 3/2010 | Belashchenko |
| 7,811,429 | B2 | 10/2010 | Landgraf et al. |
| 7,815,782 | B2 | 10/2010 | Inagawa et al. |
| 7,901,552 | B2 | 3/2011 | Pavloff |
| 7,910,051 | B2 | 3/2011 | Zimmermann et al. |
| 7,951,275 | B2 | 5/2011 | Tsukamoto |
| 8,002,169 | B2 | 8/2011 | Miller et al. |
| 8,043,655 | B2 | 10/2011 | Miller et al. |
| 8,197,661 | B1 | 6/2012 | Nanis |
| 8,197,894 | B2 | 6/2012 | Miller et al. |
| 2001/0054457 | A1 | 12/2001 | Segal et al. |
| 2002/0112789 | A1 | 8/2002 | Jepson et al. |
| 2002/0112955 | A1 | 8/2002 | Aimone et al. |
| 2003/0023132 | A1 | 1/2003 | Melvin et al. |
| 2003/0052000 | A1 | 3/2003 | Segal et al. |
| 2003/0175142 | A1 | 9/2003 | Milonopoulou et al. |
| 2003/0178301 | A1 | 9/2003 | Lynn et al. |
| 2003/0190413 | A1 | 10/2003 | Van Steenkiste et al. |
| 2003/0219542 | A1 | 11/2003 | Ewasyshyn et al. |
| 2003/0232132 | A1 | 12/2003 | Muehlberger |
| 2004/0037954 | A1 | 2/2004 | Heinrich et al. |
| 2004/0065546 | A1 | 4/2004 | Michaluk et al. |
| 2004/0076807 | A1 | 4/2004 | Grinberg et al. |
| 2004/0126499 | A1 | 7/2004 | Heinrich et al. |
| 2004/0202885 | A1 | 10/2004 | Seth et al. |

| | | | |
|---|---|---|---|
| 2004/0262157 | A1 | 12/2004 | Ford et al. |
| 2005/0084701 | A1 | 4/2005 | Slattery |
| 2005/0120957 | A1 | 6/2005 | Kowalsky et al. |
| 2005/0142021 | A1 | 6/2005 | Aimone et al. |
| 2005/0147150 | A1 | 7/2005 | Wickersham et al. |
| 2005/0147742 | A1 | 7/2005 | Kleshock et al. |
| 2005/0153069 | A1 | 7/2005 | Tapphorn et al. |
| 2005/0155856 | A1 | 7/2005 | Oda |
| 2005/0220995 | A1 | 10/2005 | Hu et al. |
| 2005/0252450 | A1 | 11/2005 | Kowalsky et al. |
| 2006/0006064 | A1 | 1/2006 | Tepman |
| 2006/0011470 | A1 | 1/2006 | Hatch et al. |
| 2006/0021870 | A1 | 2/2006 | Tsai et al. |
| 2006/0027687 | A1 | 2/2006 | Heinrich et al. |
| 2006/0032735 | A1 | 2/2006 | Aimone et al. |
| 2006/0042728 | A1 | 3/2006 | Lemon et al. |
| 2006/0045785 | A1 | 3/2006 | Hu et al. |
| 2006/0090593 | A1 | 5/2006 | Liu |
| 2006/0121187 | A1 | 6/2006 | Haynes et al. |
| 2006/0137969 | A1 | 6/2006 | Feldewerth et al. |
| 2006/0175198 | A1 | 8/2006 | Vermeersch et al. |
| 2006/0207876 | A1 | 9/2006 | Matsumura et al. |
| 2006/0251872 | A1 | 11/2006 | Wang et al. |
| 2006/0266639 | A1 | 11/2006 | Le et al. |
| 2006/0289305 | A1 | 12/2006 | White |
| 2007/0012557 | A1 | 1/2007 | Hosokawa et al. |
| 2007/0089984 | A1 | 4/2007 | Gaydos et al. |
| 2007/0116886 | A1 | 5/2007 | Refke et al. |
| 2007/0116890 | A1 | 5/2007 | Adams et al. |
| 2007/0172378 | A1 | 7/2007 | Shibuya et al. |
| 2007/0183919 | A1 | 8/2007 | Ayer et al. |
| 2007/0187525 | A1 | 8/2007 | Jabado et al. |
| 2007/0196570 | A1 | 8/2007 | Gentsch et al. |
| 2007/0240980 | A1 | 10/2007 | Chu et al. |
| 2007/0241164 | A1 | 10/2007 | Barnes et al. |
| 2007/0251814 | A1 | 11/2007 | Beele et al. |
| 2007/0289864 | A1 | 12/2007 | Ye et al. |
| 2007/0289869 | A1 | 12/2007 | Ye et al. |
| 2008/0028459 | A1 | 1/2008 | Suh et al. |
| 2008/0041720 | A1 | 2/2008 | Kim et al. |
| 2008/0063889 | A1 | 3/2008 | Duckham et al. |
| 2008/0078268 | A1 | 4/2008 | Shekhter et al. |
| 2008/0145688 | A1 | 6/2008 | Miller et al. |
| 2008/0171215 | A1 | 7/2008 | Kumar et al. |
| 2008/0173542 | A1 | 7/2008 | Neudecker et al. |
| 2008/0216602 | A1 | 9/2008 | Zimmermann et al. |
| 2008/0271779 | A1 | 11/2008 | Miller et al. |
| 2009/0004379 | A1 | 1/2009 | Deng et al. |
| 2009/0010792 | A1 | 1/2009 | Yi et al. |
| 2009/0159433 | A1 | 6/2009 | Neudecker et al. |
| 2009/0173626 | A1 | 7/2009 | Duckham et al. |
| 2009/0214374 | A1 | 8/2009 | Ivanov |
| 2009/0239754 | A1 | 9/2009 | Kruger et al. |
| 2009/0291851 | A1 | 11/2009 | Bohn |
| 2010/0000857 | A1 | 1/2010 | Tonogi et al. |
| 2010/0015467 | A1 | 1/2010 | Zimmermann et al. |
| 2010/0055487 | A1 | 3/2010 | Zimmermann et al. |
| 2010/0061876 | A1 | 3/2010 | Miller et al. |
| 2010/0084052 | A1 | 4/2010 | Farmer et al. |
| 2010/0086800 | A1 | 4/2010 | Miller et al. |
| 2010/0136242 | A1 | 6/2010 | Kay et al. |
| 2010/0172789 | A1 | 7/2010 | Calla et al. |
| 2010/0189910 | A1 | 7/2010 | Belashchenko |
| 2010/0246774 | A1 | 9/2010 | Lathrop |
| 2010/0252418 | A1 | 10/2010 | McCabe et al. |
| 2010/0272889 | A1 | 10/2010 | Shekhter et al. |
| 2011/0127162 | A1 | 6/2011 | King et al. |
| 2011/0132534 | A1 | 6/2011 | Miller et al. |
| 2011/0297535 | A1 | 12/2011 | Higdon et al. |
| 2011/0300396 | A1 | 12/2011 | Miller et al. |
| 2011/0303535 | A1 | 12/2011 | Miller et al. |
| 2012/0000594 | A1 | 1/2012 | Ivanov et al. |
| 2012/0017521 | A1 | 1/2012 | Botke |
| 2012/0061235 | A1 | 3/2012 | Feldman-Peabody |

FOREIGN PATENT DOCUMENTS

| | | | |
|---|---|---|---|
| EP | 0 074 803 | A1 | 3/1983 |
| EP | 0 484 533 | A1 | 5/1992 |
| EP | 0 774 315 | A2 | 5/1997 |
| EP | 1 066 899 | A2 | 1/2001 |
| EP | 1 138 420 | A2 | 10/2001 |
| EP | 1 350 861 | A1 | 10/2003 |
| EP | 1 382 720 | A2 | 1/2004 |
| EP | 1 398 394 | A1 | 3/2004 |
| EP | 1 413 642 | A1 | 4/2004 |
| EP | 1 452 622 | A2 | 9/2004 |
| EP | 1556526 | A2 | 7/2005 |
| EP | 1639620 | A2 | 3/2006 |
| EP | 1 715 080 | A1 | 10/2006 |
| EP | 1728892 | A2 | 12/2006 |
| EP | 2135973 | A1 | 12/2009 |
| EP | 2145976 | A1 | 1/2010 |
| EP | 2 206 804 | A1 | 7/2010 |
| GB | 2 121 441 | A | 12/1983 |
| GB | 2 394 479 | A | 4/2004 |
| JP | 54067198 | A | 5/1979 |
| JP | 63035769 | A | 2/1988 |
| JP | 63100177 | A | 5/1988 |
| JP | 03197640 | A | 8/1991 |
| JP | 05/015915 | A | 1/1993 |
| JP | 05/232580 | A | 9/1993 |
| JP | 06/144124 | A | 5/1994 |
| JP | 06346232 | A | 12/1994 |
| JP | 08/169464 | A | 7/1996 |
| JP | 11269637 | A | 10/1999 |
| JP | 11269639 | A | 10/1999 |
| JP | 2001098359 | A | 4/2001 |
| JP | 01/131767 | | 5/2001 |
| JP | 2001123267 | A | 5/2001 |
| JP | 03/301278 | B2 | 7/2002 |
| JP | 2003201561 | A | 7/2003 |
| JP | 2003226966 | A | 8/2003 |
| JP | 2006144124 | A | 6/2006 |
| RU | 2166421 | C1 | 5/2001 |
| WO | WO-93/19220 | A1 | 9/1993 |
| WO | WO-96/33294 | A1 | 10/1996 |
| WO | WO-98/37249 | A1 | 8/1998 |
| WO | WO-00/06793 | A1 | 2/2000 |
| WO | WO-01/12364 | A1 | 2/2001 |
| WO | WO-02/064287 | A2 | 8/2002 |
| WO | WO-02/070765 | A1 | 9/2002 |
| WO | WO-03/062491 | A2 | 7/2003 |
| WO | WO-03/106051 | A1 | 12/2003 |
| WO | WO-03/106733 | A1 | 12/2003 |
| WO | WO-03106733 | A1 | 12/2003 |
| WO | WO-2004/074540 | A1 | 9/2004 |
| WO | WO-2004/076706 | A2 | 9/2004 |
| WO | WO-2004/114355 | A2 | 12/2004 |
| WO | WO-2005/073418 | A1 | 8/2005 |
| WO | WO-2005/079209 | A2 | 9/2005 |
| WO | WO-2005/084242 | A2 | 9/2005 |
| WO | WO-2006/117144 | A1 | 11/2006 |
| WO | WO-2006/117145 | A2 | 11/2006 |
| WO | WO-2006129941 | A1 | 12/2006 |
| WO | WO-2007/001441 | A2 | 1/2007 |
| WO | WO-2008/033192 | A1 | 3/2008 |
| WO | WO-2008/042947 | A2 | 4/2008 |
| WO | WO-2008/063891 | A2 | 5/2008 |
| WO | WO-2008/089188 | A1 | 7/2008 |

OTHER PUBLICATIONS

"Cold Spray Process," Handbook of Thermal Spray Technology, ASM International, Sep. 2004, pp. 77-84.

Ajdelsztajn et al., "Synthesis and Mechanical Properties of Nanocrytalline Ni Coatings Producted by Cold Gas Dynamic Spraying," 201 Surface and Coatings Tech. 3-4, pp. 1166-1172 (Oct. 2006).

Examination Report in European Patent Application No. 09172234.8, mailed Jun. 16, 2010 (3 pages).

Gärtner et al., "The Cold Spray Process and its Potential for Industrial Applications," 15 J. of Thermal Sprsy Tech. 2, pp. 223-232 (Jun. 2006).

Hall et al., "The Effect of a Simple Annealing Heat Treatment on the Mechanical Properties of Cold-Sprayed Aluminum," 15 J. of Thermal Spray Tech. 2, pp. 233-238 (Jun. 2006.).

Hall et al., "Preparation of Aluminum Coatings Containing Homogeneous Nanocrystalline Microstructures Using the Cold Spray Process," JTTEES 17:352-359.

IPRP in International Patent Application No. PCT/EP2006/003967, dated Nov. 6, 2007 (15 pages).
IPRP in International Patent Application No. PCT/US2008/062434, dated Nov. 10, 2009 (21 pages).
IPRP in International Patent Application No. PCT/EP2006/003969, mailed dated Nov. 6, 2007 (13 pages).
International Search Report and Written Opinion in International Patent Application No. PCT/US2007/087214, mailed Mar. 23, 2009 (13 pages).
IPRP in International Patent Application No. PCT/US2007/081200, dated Sep. 1, 2009 (17 pages).
IPRP in International Patent Application No. PCT/US2007/080282, dated Apr. 7, 2009 (15 pages).
Irissou et al., "Review on Cold Spray Process and Technology: Part I—Intellectual Property," 17 J. of Thermal Spray Tech. 4, pp. 495-516 (Dec. 2008).
Karthikeyan, "Cold Spray Technology: International Status and USA Efforts," ASB Industries, Inc. (Dec. 2004).
Li et al., "Effect of Annealing Treatment on the Microstructure and Properties of Cold-Sprayed Cu Coating," 15 J. of Thermal Spray Tech. 2, pp. 206-211 (Jun. 2006).
Marx et al., "Cold Spraying—Innovative Layers for New Applications," 15 J. of Thermal Spray Tech. 2, pp. 177-183 (Jun. 2006).
Morito, "Preparation and Characterization of Sintered Mo-Re Alloys," 3 J. de Physique 7, Part 1, pp. 553-556 (1993).
Search Report in European Patent Application No. 09172234.8, dated Jan. 29, 2010 (7 pages).
Stoltenhoff et al., "An Analysis of the Cold Spray Process and its Coatings," 11 J. of Thermal Spray Tech. 4, pp. 542-550 (Dec. 2002).
Van Steenkiste et al., "Analysis of Tantalum Coatings Produced by the Kinetic Spray Process," 13 J. of Thermal Spray Tech. 2, pp. 265-273 (Jun. 2004).
Kosarev et al., "Recently Patent Facilities and Applications in Cold Spray Engineering," Recent Patents on Engineering, vol. 1 pp. 35-42 (2007).
Examination Report in European Patent Application No. 07843733.2, mailed Nov. 30, 2010 (9 pages).
English Translation of Office Action mailed Feb. 23, 2011 for Chinese Patent Application No. 200880023411.5 (7 pages).
Examination Report in European Patent Application No. 08755010.9, mailed Sep. 16, 2011 (3 pages).
Examination Report in Canadian Patent Application No. 2,736,876, mailed Feb. 29, 2012 (4 pages).
Tapphorn et al., "The Solid-State Spray Forming of Low-Oxide Titanium Components," JOM, p. 45-47 (1998).
Office Action mailed Nov. 23, 2011 for Chinese Patent Application No. 200880023411.5 (3 pages).
English Translation of Office Action mailed Jun. 26, 2012 for Japanese Patent Application No. 2010-506677 (6 pages).
English Translation of Office Action mailed Sep. 7, 2010 for Chinese Patent Application No. 200780036469.9 (6 pages).

DYNAMIC DEHYDRIDING OF REFRACTORY METAL POWDERS

RELATED APPLICATION

This application is a continuation of U.S. patent application Ser. No. 12/206,944, filed Sep. 9, 2008, the entire disclosure of which is incorporated by reference herein.

BACKGROUND OF THE INVENTION

Many refractory metal powders (Ta, Nb, Ti, Zr, etc) are made by hydriding an ingot of a specific material. Hydriding embrittles the metal allowing it to be easily comminuted or ground into fine powder. The powder is then loaded in trays and placed in a vacuum vessel, and in a batch process is raised to a temperature under vacuum where the hydride decomposes and the hydrogen is driven off. In principle, once the hydrogen is removed the powder regains its ductility and other desirable mechanical properties. However, in removing the hydrogen, the metal powder can become very reactive and sensitive to oxygen pickup. The finer the powder, the greater the total surface area, and hence the more reactive and sensitive the powder is to oxygen pickup. For tantalum powder of approximately 10-44 microns in size after dehydriding and conversion to a true Ta powder the oxygen pickup can be 300 ppm and even greater. This amount of oxygen again embrittles the material and greatly reduces its useful applications.

To prevent this oxygen pickup the hydride powder must be converted to a bulk, non hydride solid which greatly decreases the surface area in the shortest time possible while in an inert environment. The dehydriding step is necessary since as mentioned previously the hydride is brittle, hard and does not bond well with other powder particles to make usable macroscopic or bulk objects. The problem this invention solves is that of converting the hydride powder to a bulk metal solid with substantially no oxygen pickup.

SUMMARY OF INVENTION

We have discovered how to go directly from tantalum hydride powder directly to bulk pieces of tantalum a very short time frame (a few tenths of a second, or even less). This is done in a dynamic, continuous process as opposed to conventional static, batch processing. The process is conducted at positive pressure and preferably high pressure, as opposed to vacuum. The dehydriding process occurs rapidly in a completely inert environment on a powder particle by powder particle basis with consolidation occurring immediately at the end of the dehydriding process. Once consolidated the problem of oxygen pick up is eliminated by the huge reduction in surface area that occurs with the consolidation of fine powder into a bulk object.

DETAILED DESCRIPTION OF THE INVENTION

The equilibrium solubility of hydrogen in metal is a function of temperature. For many metals the solubility decreases markedly with increased temperature and in fact if a hydrogen saturated metal has its temperature raised the hydrogen will gradually diffuse out of the metal until a new lower hydrogen concentration is reached. The basis for this is shown clearly in FIG. 1. At 200 C Ta absorbs hydrogen up to an atomic ratio of 0.7 (4020 ppm hydrogen), but if the temperature is raised to 900 C the maximum hydrogen the tantalum can absorb is an atomic ratio of 0.03 (170 ppm hydrogen). Thus, we observe what is well known in the art, that the hydrogen content of a metal can be controllably reduced by increasing the temperature of the metal. Note this figure provides data where the hydrogen partial pressure is one atmosphere.

Figure 1:
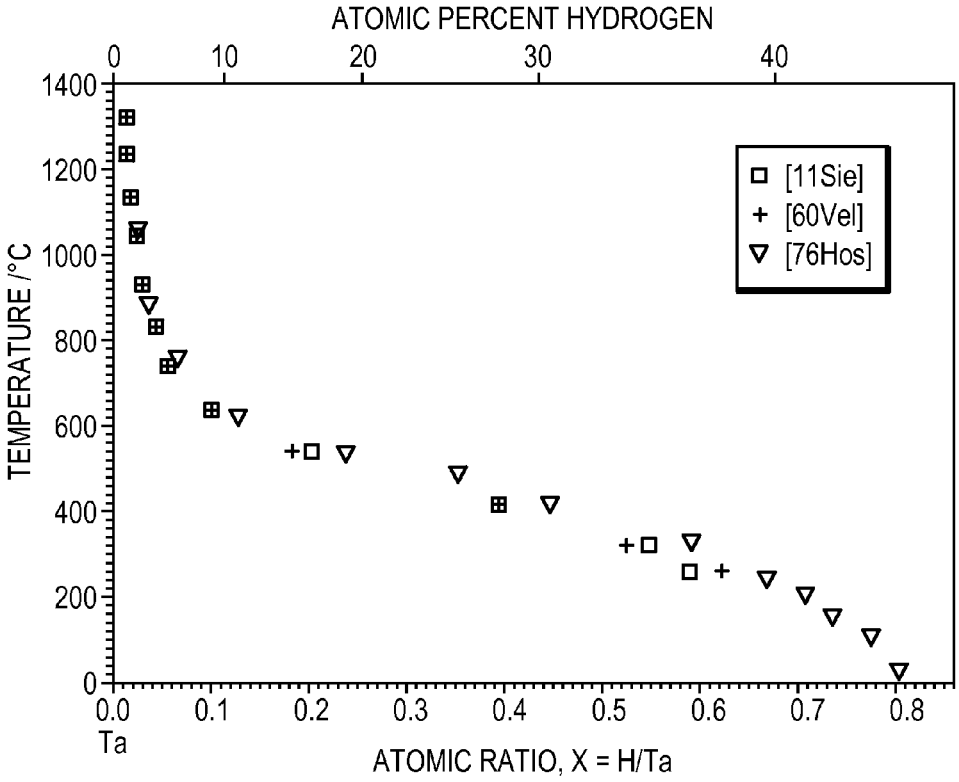
FIG. 1 is a graph showing solubility of H in Ta at atmospheric pressure From "the H—Ta (Hydrogen-Tantalum) System" San-Martin and F. D. Manchester in *Phase diagrams of Binary Tantalum Alloys*, eds Garg, Venatraman, Krishnamurthy and Krishman, Indian Institue of Metals, Calucutta, 1996 pgs. 65-78.

Vacuum is normally applied in the dehydride process to keep a low partial pressure of hydrogen in the local environment to prevent Le Chateliers's principle from slowing and stopping the dehydriding. We have found we can suppress the local hydrogen partial pressure not just by vacuum but also by surrounding the powder particles with a flowing gas. And further, the use of a high pressure flowing gas advantageously allows the particles to be accelerated to a high velocity and cooled to a low temperature later in the process What is not known from FIG. 1, is if the temperature of the tantalum was instantly increased from room temperature to 900 C, how long would it take for the hydrogen concentration to decrease to the new equilibrium concentration level.

Information from diffusion calculations are summarized in Table 1. The calculations were made assuming a starting concentration of 4000 ppm hydrogen and a final concentration of 10 ppm hydrogen. The calculations are approximate and not an exact solution. What is readily apparent from Table 1 is that hydrogen is extremely mobile in tantalum even at low temperatures and that for the particle sizes (<40 microns) typically used in low temperature (600-1000 C) spraying operations diffusion times are in the order of a few thousandths of a second. In fact even for very large powder, 150 microns, it is less than half a second at process temperatures of 600 C and above. In other words, in a dynamic process the powder needs to be at temperature only a very short time be dehydrided to 10 ppm. In fact the time requirement is even shorter because when the hydrogen content is less than approximately 50 ppm hydrogen no longer causes embrittlement or excessive work hardening.

TABLE 1

Calculated hydrogen diffusion times in tantalum

| Temp. © | D (cm2/s) | Particle size 20 microns Time (s) | Particle size 40 microns Time (s) | Particle size 90 microns Time (s) | Particle size 150 microns Time (s) | Particle size 400 microns Time (s) |
|---|---|---|---|---|---|---|
| 200 | 1.11e−05 | 0.0330 | 0.1319 | 0.6676 | 1.8544 | 13.1866 |
| 400 | 2.72e−05 | 0.0135 | 0.0539 | 0.2728 | 0.7576 | 5.3877 |

TABLE 1-continued

Calculated hydrogen diffusion times in tantalum

| Temp. © | D (cm2/s) | Particle size 20 microns Time (s) | Particle size 40 microns Time (s) | Particle size 90 microns Time (s) | Particle size 150 microns Time (s) | Particle size 400 microns Time (s) |
|---|---|---|---|---|---|---|
| 600 | 4.67e−05 | 0.0078 | 0.0314 | 0.1588 | 0.4410 | 3.1363 |
| 800 | 6.62e−05 | 0.0055 | 0.0221 | 0.1120 | 0.3111 | 2.2125 |
| 1000 | 8.4e−05 | 0.0043 | 0.0174 | 0.0879 | 0.2441 | 1.7358 |
| Do = 0.00032* | | Q = −0.143 eV* | | | | |

*from From P.E. Mauger et. al., "Diffusion and Spin Lattice Relaxation of $^1$H in α $TaH_x$ and $NbH_x$", J. *Phys. Chem. Solids,* Vol. 42, No. 9, pp821-826, 1981

Figure 2:
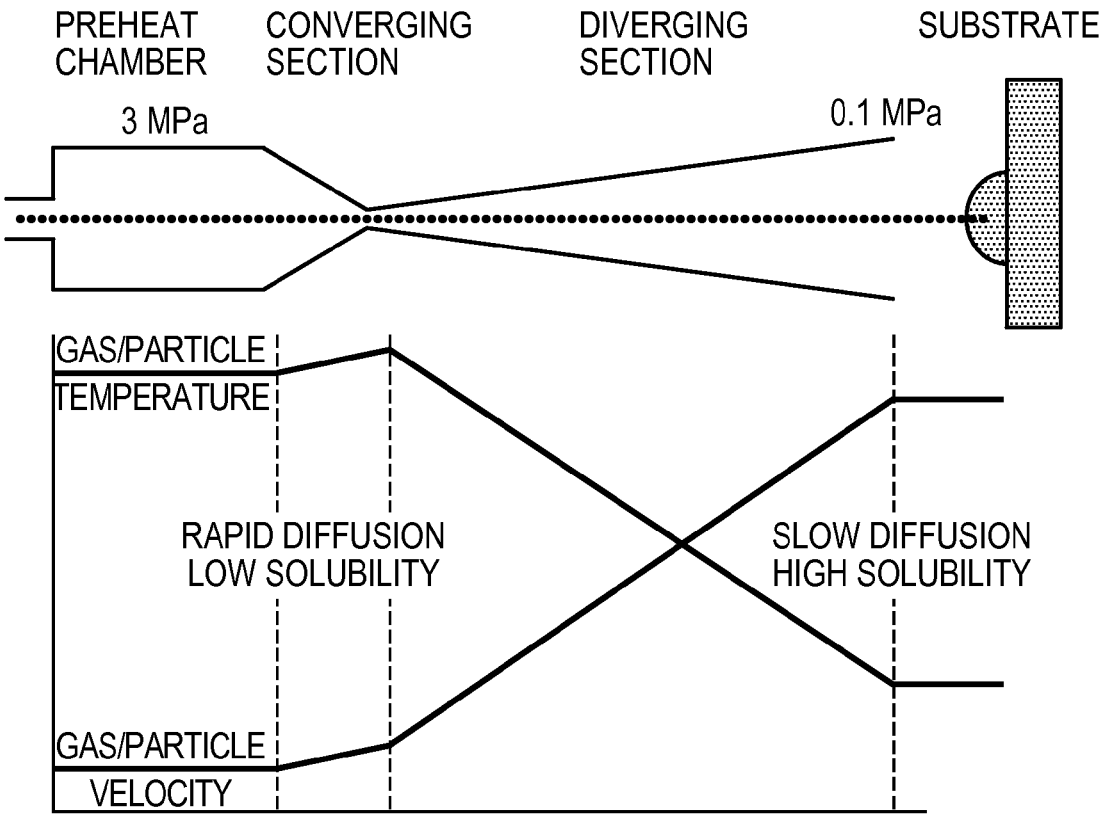
FIG. 2 schematically illustrates equipment used for this invention, showing the different process conditions and where they exist within the device.

FIG. 2 is a schematic illustration of a device designed to provide a hot zone in which the powder resides for a time sufficient to produce dehydriding followed by a cold zone where the powder residence time is too short to allow re-absorbtion of the hydrogen before the powder is consolidated by impact on a substrate. Note in the schematic the powder is traveling through the device conveyed by compressed gas going left to right. Conceptually the device is based on concepts disclosed in U.S. Pat. Nos. 6,722,584, 6,759,085, and 7,108,893 relating to what is known in the trade as cold spray apparatus and in U.S. patent applications 2005/0120957 A1, 2006/0251872 A1 and U.S. Pat. No. 6,139,913 relating to kinetic spray apparatus. All of the details of all of these patents and applications are incorporated herein by reference thereto. The design differences include: A) a preheat chamber where particle velocity and chamber length are designed not just to bring the powder to temperature but to retain the powder fully heated in the hot zone for a time in excess of those in Table 1 that will allow diffusion of the hydrogen out of the powder; B) a gas flow rate to metal powder flow rate ratio that insures that the partial pressure of hydrogen around the Ipowder is low; C) a cooling chamber where particle residence time is sufficiently short to prevent substantial re-absorbtion of the hydrogen by the powder and accelerates the powder particle to high velocity; and D) a substrate for the powder to impact and build a dense deposit on.

The device consists of a section comprised of the well known De Laval nozzle (converging-diverging nozzle) used for accelerating gases to high velocity, a preheat—mixing section before or upstream from the inlet to the converging section and a substrate in close proximity to the exit of the diverging section to impinge the powder particles on and build a solid, dense structure of the desired metal.

An advantage of the process of this invention is that the process is carried out under positive pressure rather than under a vacuum. Utilization of positive pressure provides for increased velocity of the powder through the device and also facilitates or permits the spraying of the powder onto the substrate. Another advantage is that the powder is immediately desified and compacted into a bulk solid greatly reducing its surface area and the problem of oxygen pickup after dehydriding.

Use of the De Laval nozzle is important to the effective of operation of this invention. The nozzle is designed to maximize the efficiency with which the potential energy of the compressed gas is converted into high gas velocity at the exit of the nozzle. The gas velocity is used to accelerate the powder to high velocity as well such that upon impact the powder welds itself to the substrate. But here the De Laval nozzle also plays another key role. As the compressed gas passes through the nozzle orifice its temperature rapidly decreases due to the well known Joule Thompson effect and further expansion. As an example for nitrogen gas at 30 bar and 650 C before the orifice when isentropically expanded through a nozzle of this type will reach an exit velocity of approximately 1100 m/s and decrease in temperature to approximately 75 C. In the region of the chamber at 650 C the hydrogen in the tantalum would have a maximum solubility of 360 ppm (in one atmosphere of hydrogen) and it would take less than approximately 0.005 seconds for the hydrogen to diffuse out of tantalum hydride previously charged to 4000 ppm. But, the powder is not in one atmosphere of hydrogen, by using a nitrogen gas for conveying the powder, it is in a nitrogen atmosphere and hence the ppm level reached would be expected to be significantly lower. In the cold region at 75 C the solubility would increase to approximately 4300 ppm. But, the diffusion analysis shows that even in a high concentration of hydrogen it would take approximately 9 milliseconds for the hydrogen to diffuse back in and because the particle is traveling through this region at near average gas velocity of 600 m/s its actual residence time is only about 0.4 milliseconds. Hence even in a pure hydrogen atmosphere there is insufficient residence time for the particle to reabsorb hydrogen. The amount reabsorbed is diminished even further since a mass balance of the powder flow of 4 kg/hr in a typical gas flow of 90 kg/hr shows that even if all the hydrogen were evolved from the hydride, the surrounding atmosphere would contain only 1.8% hydrogen further reducing the hydrogen pickup due to statistical gas dynamics.

With reference to FIG. 2 the top portion of FIG. 2 schematically illustrates the chamber or sections of a device which may be used in accordance with this invention. The lower portion of FIG. 2 shows a graph of the gas/particle temperature and a graph of the gas/particle velocity of the powder in corresponding portions of the device. Thus, as shown in FIG. 2 when the powder is in the preheat chamber at the entrance to the converging section of the converging/diverging De Laval nozzle, the temperature of the gas/particles is high and the velocity is low. At this stage of the process there is rapid diffusion and low solubility. As the powder moves into the converging section conveyed by the carrier gas, the temperature may slightly increase until it is passed through the orifice and when in the diverging section the temperature rapidly decreases. In the meantime, the velocity begins to increase in the converging section to a point at about or just past the orifice and then rapidly increases through the diverging section. At this stage there is slow diffusion and high solubility. The temperature and velocity may remain generally constant in the portion of the device, after the nozzle exit and before the substrate.

One aspect of the invention broadly relates to a process and another aspect of the invention relates to a device for dehydriding refractory metal powders. Such device includes a preheat chamber at the inlet to a converging/diverging nozzle for retaining the metal powder fully heated in a hot zone to allow diffusion of hydrogen out of the powder. The nozzle includes a cooling chamber downstream from the orifice in the diverging portion of the device. In this cooling chamber the temperature rapidly decreases while the velocity of the gas/particles (i.e. carrier gas and powder) rapidly increases. Substantial re-absorption of the hydrogen by the powder is prevented. Finally, the powder is impacted against and builds a dense deposit on a substrate located at the exit of the nozzle to dynamically dehydride the metal powder and consolidate it into a high density metal on the substrate.

Cooling in the nozzle is due to the Joule Thompson effect. The operation of the device permits the dehydriding process to be a dynamic continuous process as opposed to one which is static or a batch processing. The process is conducted at positive and preferably high pressure, as opposed to vacuum and occurs rapidly in a completely inert or non reactive environment.

The inert environment is created by using any suitable inert gas such as, helium or argon or a nonreactive gas such as nitrogen as the carrier gas fed through the nozzle. In the preferred practice of this invention an inert gas environment is maintained throughout the length of the device from and including the powder feeder, through the preheat chamber to the exit of the nozzle. In a preferred practice of the invention the substrate chamber also has an inert atmosphere, although the invention could be practiced where the substrate chamber is exposed to the normal (i.e. not-inert) atmosphere environment. Preferably the substrate is located within about 10 millimeters of the exit. Longer or shorter distances can be used within this invention. If there is a larger gap between the substrate chamber and the exit, this would decrease the effectiveness of the powder being consolidated into the high density metal on the substrate. Even longer distances would result in a loose dehydrided powder rather than a dense deposit.

Experimental Support

The results of using this invention to process tantalum hydride powder −44+20 microns in size using a Kinetiks 4000 system (this is a standard unit sold for cold spray applications that allows heating of the gas) and the conditions used are shown in Table II. Two separate experiments were conducted using two types of gas at different preheat temperatures. The tantalum hydride powder all came from the same lot, was sieved to a size range of −44+20 microns and had a measured hydrogen content of approximately 3900 ppm prior to being processed. Processing reduced the hydrogen content approximately 2 orders of magnitude to approximately 50-90 ppm. All this was attained without optimizing the gun design. The residence time of the powder in the hot inlet section of the gun (where dehydriding occurs) is estimated to be less than 0.1 seconds, residence time in the cold section is estimated to be less than 0.5 milliseconds (where the danger of hydrogen pickup and oxidation occurs). One method of optimization would simply be to extend the length of the hot/preheat zone of the gun, add a preheater to the powder delivery tube just before the inlet to the gun or simply raise the temperature that the powder was heated to.

TABLE II

Experimental results showing the hydrogen decrease in tantalum powder using this process

| Gas Type | Gas Pressure (Bar) | Gas Temperature © | Initial Hydrogen Content (ppm) | Final Hydrogen Content (ppm) |
|---|---|---|---|---|
| Helium | 35 | 500 | 3863 | 60.85 |
| Nitrogen | 35 | 750 | 3863 | 54.77 |

As noted the above experiment was performed using a standard Kinetecs 400 system, and was able to reduce hydrogen content for tantalum hydride to the 50-90 PPM level for the powder size tested. I.e. the residence time in hot sections of the standard gun was sufficient to drive most of the hydrogen out for tantalum powders less than 44 mictons in size.

The following example provides a means of designing the preheat or prechamber to produce even lower hydrogen content levels and to accommodate dehydriding larger powders that would require longer times at temperature. The results of the calculations are shown in table III below

TABLE 1

Example calculations to determine prechamber configuration.

| | Tantalum (10 um) H = 4000 ppm | Niobium (10 um) H = 9900 ppm |
|---|---|---|
| Avg. Particle Temperature in the prechamber (C.) | 750 | 750 |
| Initial Particle Velocity at the nozzle inlet (m/sec) | 4.49E−02 | 4.37E−02 |
| Dehydriding Time (100 ppm) (sec) | 1.31E−03 | 1.10E−03 |
| Dehydriding Time (50 ppm) (sec) | 1.49E−03 | 1.21E−03 |
| Dehydriding Time (10 ppm) (sec) | 1.86E−03 | 1.44E−03 |
| Prechamber Residence Time (sec) | 1.86E−03 | 1.44E−03 |
| Avg. Particle Velocity in the Prechamber (m/sec) | 4.00E−02 | 4.00E−02 |
| Prechamber Length (mm) | 0.074 | 0.058 |
| | **Tantalum (400 um) H = 4000 ppm)** | **Niobium (400 um) H = 9900 ppm** |
| Avg. Particle Temperature in the prechamber (C.) | 750 | 750 |
| Initial Particle Velocity at the nozzle inlet (m/sec) | 3.46E−04 | 6.73E−04 |
| Dehydriding Time (100 ppm) (sec) | 2.09E+00 | 1.75E+00 |
| Dehydriding Time (50 ppm) (sec) | 2.39E+00 | 1.94E+00 |
| Dehydriding Time (10 ppm) (sec) | 2.97E+00 | 2.30E+00 |
| Prechamber Residence Time (sec) | 2.97 | 2.30 |
| Avg. Particle Velocity in the Prechamber (m/sec) | 3.00E−04 | 6.00E−04 |
| Prechamber Length (mm) | 0.892 | 1.382 |

The calculations are for tantalum and niobium powders, 10 and 400 microns in diameter, that have been assumed to be initially charged with 4000 and 9900 ppm hydrogen respectively.

The powders are preheated to 750 C. The required times at temperature to dehydride to 100, 50 and 10 ppm hydrogen are shown in the table . . . are shown. The goal is to reduce hydrogen content to 10 ppm so the prechamber length is calculated as the product of the particle velocity and the required dehydriding time to attain 10 ppm. What is immediately apparent is the reaction is extremely fast, calculated prechamber lengths are extremely short (less than 1.5 mm in the longest case in this example.) making it easy to use a conservative prechamber length of 10-20 cm insuring that this dehydriding process is very robust in nature, easily completed before the powder enters the gun, and able to handle a wide range of process variation.

What is claimed is:

1. A method of forming a metallic deposit, the method comprising:

supplying a metal hydride powder to a spray-deposition nozzle;

within the spray-deposition nozzle, (i) heating the metal hydride powder to decrease a hydrogen content thereof, thereby forming a metal powder substantially free of hydrogen, and (ii) cooling the metal powder for a sufficiently small cooling time to prevent reabsorption of hydrogen into the metal powder; and spraying the metal powder from the spray-deposition nozzle on a substrate to form a solid deposit thereon.

2. The method of claim 1, wherein the spray-deposition nozzle comprises converging and diverging sections.

3. The method of claim 1, wherein a distance between an outlet of the spray-deposition nozzle and the substrate is less than approximately 10 mm.

4. The method of claim 1, wherein heating of the metal hydride powder and the cooling of the metal powder are performed under a positive pressure of an inert gas.

5. The method of claim 1, wherein a hydrogen content of the metal hydride powder is greater than approximately 3900 ppm before heating.

6. The method of claim 1, wherein a hydrogen content of the metal powder is less than approximately 100 ppm after it is sprayed.

7. The method of claim 6, wherein the hydrogen content of the metal powder is less than approximately 50 ppm after it is sprayed.

8. The method of claim 1, wherein the metal hydride powder comprises a refractory metal hydride powder.

9. The method of claim 1, wherein an oxygen content of the solid deposit is less than approximately 200 ppm.

10. The method of claim 1, wherein spraying the metal powder comprises cold spraying the metal powder.

11. The method of claim 1, wherein a hydrogen content of the metal hydride powder decreases by at least two orders of magnitude during heating.

12. The method of claim 1, wherein an oxygen content of the metal powder does not increase during cooling.

13. The method of claim 1, further comprising providing an inert gas within the spray-deposition nozzle.

14. The method of claim 1, wherein forming the solid deposit substantially prevents oxygen absorption into the metal powder.

* * * * *